US006614168B2

(12) United States Patent
Hsiao et al.

(10) Patent No.: US 6,614,168 B2
(45) Date of Patent: Sep. 2, 2003

(54) PACKAGE METHOD FOR FIELD EMISSION DISPLAY

(75) Inventors: Ming-Chun Hsiao, Hsinchu Hsien (TW); Cheng-Chung Lee, Hsinchu Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 20 days.

(21) Appl. No.: 10/042,322

(22) Filed: Jan. 11, 2002

(65) Prior Publication Data

US 2003/0132698 A1 Jul. 17, 2003

(51) Int. Cl.[7] ..... H01J 1/62; H01J 63/04

(52) U.S. Cl. ..... 313/495; 313/495; 313/496; 313/497; 445/25

(58) Field of Search ..... 313/495, 496, 313/497; 445/24, 25

(56) References Cited

U.S. PATENT DOCUMENTS 5,336,121 A * 8/1994 Baret ..... 445/25
5,754,003 A * 5/1998 Murai et al. ..... 445/25
5,876,260 A * 3/1999 Pepi et al. ..... 445/25
6,006,003 A * 12/1999 Kim ..... 445/25

FOREIGN PATENT DOCUMENTS

JP 2000311630 A * 11/2000 ..... H01J/29/86

* cited by examiner

*Primary Examiner*—Kenneth J. Ramsey
*Assistant Examiner*—Mariceli Santiago
(74) *Attorney, Agent, or Firm*—Sughrue Mion, PLLC

(57) ABSTRACT

The present invention describes a package method for a field emission display. First, a photolithography or a laser process is used to fix the location of the side glasses on the anode and cathode plates. Next, these side glasses are respectively bonded to the anode and cathode plates. Then, an alignment process is performed to generate a gap between the side glasses and the gap is filled with glass frits. Finally, the whole structure undergoes a thermal cycle to make the side glasses adhere to each other so that the anode plate and the cathode plate may be sealed.

15 Claims, 4 Drawing Sheets

PACKAGE METHOD FOR FIELD EMISSION DISPLAY

FIELD OF THE INVENTION

The present invention relates to a package structure of a display, and especially to a package structure of a field emission display.

BACKGROUND OF THE INVENTION

There are many kinds of displays, such as liquid crystal display (LCD), field emission display and plasma display. These displays in accordance with their features are applied in the portable computers, personal digital assistants and color televisions. With the advance of techniques for manufacture and design, these displays have been introduced into the field, and have gradually replaced the CRT used for conventional display.

The structure of a field emission display (FED) is shown in FIG. 1 and includes the cathode plate 122 and anode plate 120. The anode plate 120 includes the upper glass substrate 100 whereon a layer of fluorescence material 102 is deposited. The cathode plate 122 includes the lower glass substrate 110 where the emitter layer 104 is deposited or coated. The side glasses 106 are used to separate the anode plate 120 from the cathode plate 122 by a distance of about 0.5 mm to 2 mm. Photolithography or laser process is used to fix the location of the side glasses 106 on the upper glass substrate 100 or the lower glass substrate 110. Next, glass frits 108 is used to bond the side glasses 106 on the upper glass substrate 100 or the lower glass substrate 110. If the side glasses 106 are bound on the upper glass substrate 100, after aligning the lower glass substrate 110, the glass frits 108 is applied to the adjoining part of the side glasses 106 and the lower glass substrate 100 to adhere them to each other. The two glass substrates 100 and 110 may be adhered to each other by this way.

In the high vacuum situation, when an electric voltage difference exists between the two glass substrates 100 and 110, the field emitting electrons of the emitter 104 are attracted out of the cathode plate 122 and accelerated to hit the fluorescence material 102 of the anode plate 120, causing luminescence. Therefore, after accomplishing the whole package process, an exhausting process must be performed to achieve a vacuum degree lower than the $10^{-6}$ torr between the two glass substrates 100 and 110. This ensures that the field emitting electrons are not affected by the residual gas thereof. The residual gas may reduce the efficiency of luminescence and the life time of emitters 104.

In the conventional package technology, first, the side glasses 106 are fixed on the upper glass substrate 100 or the lower glass substrate 110. Next, the glass frits 108 is applied to the side glasses 106, after aligning the two glass substrates, to adhere one to the other to finish the package process. However, because the glass frits is used on the two ends of the side glasses 106, at least the following drawbacks exist in the conventional package process:

(1) If the glass frits 108 is not uniformly applied to the side glasses 106, stress may cause the two glass substrates to break during the package process.

(2) After the package alignment process is finished, the whole structure undergoes a thermal cyclecycle. The glass frits 108 is in a fusion state during the thermal cyclecycle. If the glass frits 108 is not uniformly applied to the side glasses 108, the two glass substrates 100 and 110 may shift by shear stress, resulting in misalignment.

(3) Even if the misaligned glass substrates pass safely through the thermal cycle, the probability of breakage during use will increase due to the non-uniform glass frits 108

SUMMARY OF THE INVENTION

It is difficult to apply the glass frits uniformly to the side glasses in the conventional package method of the field emission display. As a result, the following processes will be affected. For example, in the process of aligning the two-glass substrates package process, the non-uniform glass frits may cause the two glass substrates to break. If the package alignment process is finished, misalignment between the two glass substrates usually happens because the non-uniform glass frits causes the two glass substrates to slide in the subsequent thermal cycle. Even after the thermal cycle, the non-uniform glass frits increases the breakage probability of the two glass substrates during use because of residual stress. Therefore, the main purpose of the present invention is to provide a package structure of the field emission display to resolve the foregoing drawbacks.

In accordance with the foregoing purpose, the present invention discloses a package structure of field emission display. In accordance with the present invention, first, photolithography or laser process is used to fix the location of the side glasses on the anode plate and the cathode plate. When performing package process, the side glasses are used to separate the anode plate from the cathode plate by a distance. After the alignment process, the glass frits is used to fill the gap between the side glasses respectively belonging to the anode plate and the cathode plate. Next, the whole structure undergoes a thermal cycle at a temperature of about 300 to 450° C. Through the thermal cycle the side glasses are adhered to each other by the glass frits so that the anode plate and the cathode plate may be sealed. When a electric voltage difference exist between the two plates, the electrons of the cathode plate are attracted out of the plate and are accelerated to hit the fluorescence material of the anode plate to cause luminescence in vacuum environment.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Without limiting the spirit and scope of the present invention, the method proposed in the present invention is illustrated with one preferred embodiment of forming a field emission display package structure. Skill artisans, upon acknowledging the embodiments, can apply the present invention to any kind of display package process to eliminate the drawbacks coming from non-uniform glass frits of the conventional package process, such as a crack in the package alignment process and shift of the cathode or anode plate during the thermal cycle. The usage of the present invention is not limited by the embodiments as follows.

Figure 1:
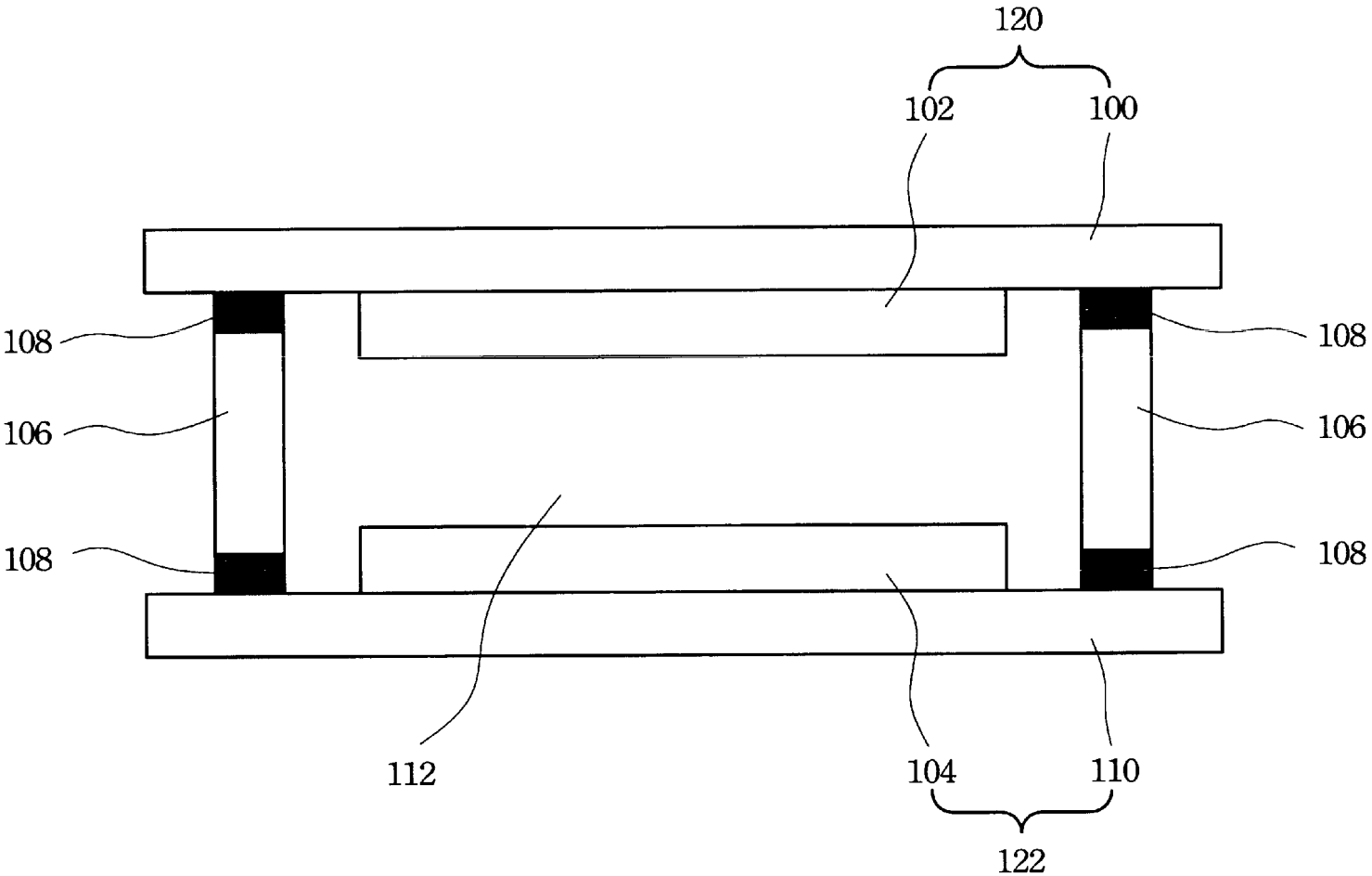
Fig. 1 (Prior Art)
FIG. 1 is a schematic cross-sectional view of a field emission display package structure in accordance with the conventional package process.
Figure 2:
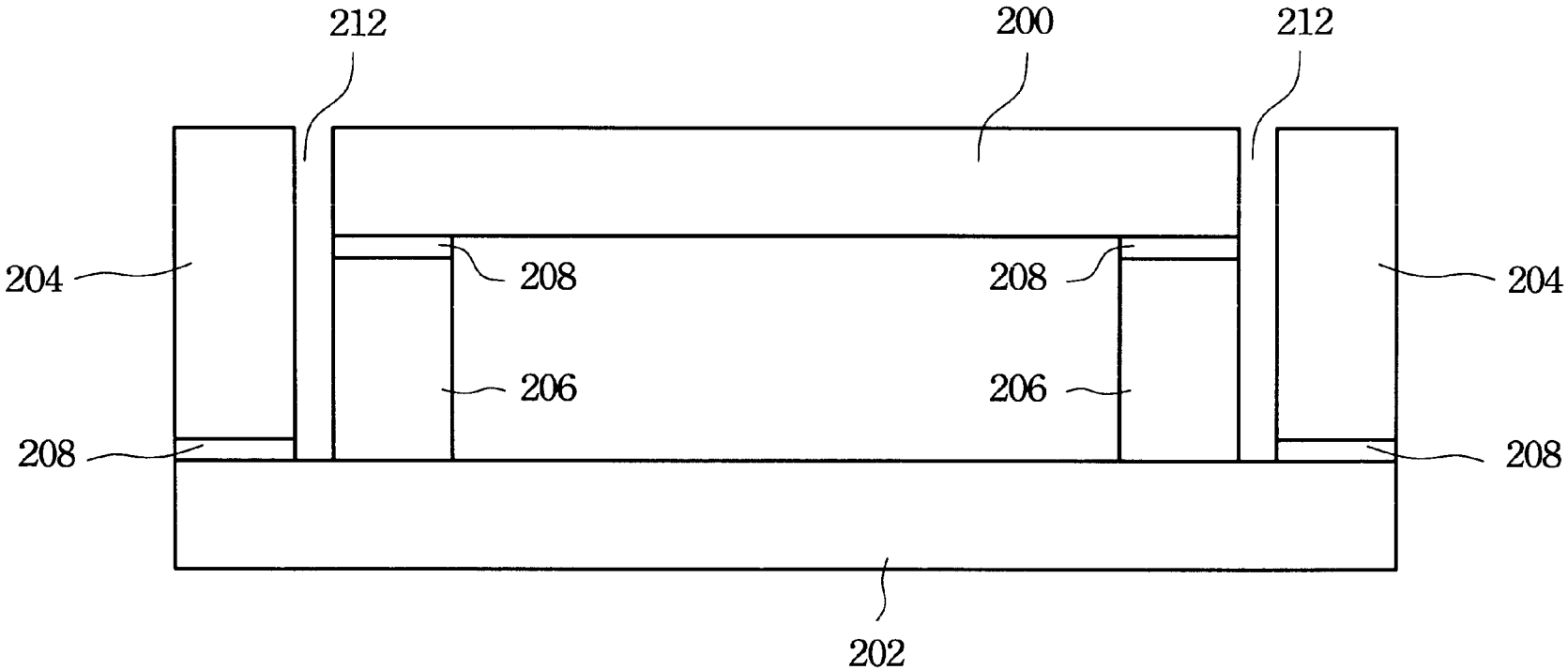
FIG. 2 is a schematic cross-sectional view of a field emission display package structure in accordance with the present invention package process.

The present invention discloses a package process and package structure of a field emission display. FIG. 2 is a schematic cross-sectional view of a field emission display package structure in accordance with the present invention package process. The anode plate 200 includes a glass substrate where a layer of fluorescence material is deposited. The cathode plate 202 includes a glass substrate where the emitter layer is deposited or coated. When a electric voltage difference exists between the anode plate 200 and cathode plate 202, the electrons of the cathode plate are attracted out of the plate and accelerated to hit the fluorescence material of the anode plate, causing luminescence in a vacuum environment.

The side glasses are used to separate the anode plate 200 from the cathode plate 202 by a distance. First, the photolithography or the laser process is used to fix the location of the side glass 206 on the anode plate 200. Next, the glass frits 208 is used to bond the side glass 206 on the anode plate 200. Similarly, the location of the side glass 204 located on the cathode plate 200 is also fixed by photolithography or laser process. Then, the glass frits 208 is used to bond the side glass 204 to the cathode plate 202. Finally, an alignment process is performed to generate a gap 212 between the side glass 206 and the side glass 204. The glass frits 208 is then used to fill the gap 212. Next, the whole structure undergoes a thermal cycle at a temperature of about 300 to 450° C. Through the thermal cycle, the side glasses 204 and 206 are adhered to each other by the glass frits 208 so that the anode plate 200 and the cathode plate 202 may be sealed.

Although the side glass 206 is also first bound on the anode plate 200 in accordance with the present invention, after aligning the cathode plate 202, the glass frit 208 is not applied to the adjoining part of the side glasses 206 and the cathode plate 202. That is, the glass frits 208 is only applied to one end of the side glasses 204 or 206. After the alignment process is performed, a gap 212 will be generated between the side glass 206 and the side glass 204. Then, the glass frits 208 is used to fill the gap 212. Next, the whole structure undergoes a thermal cycle. Through the thermal cycle the side glasses are adhered to each other by the glass frits so that the anode plate and the cathode plate may be sealed.

Figure 3:
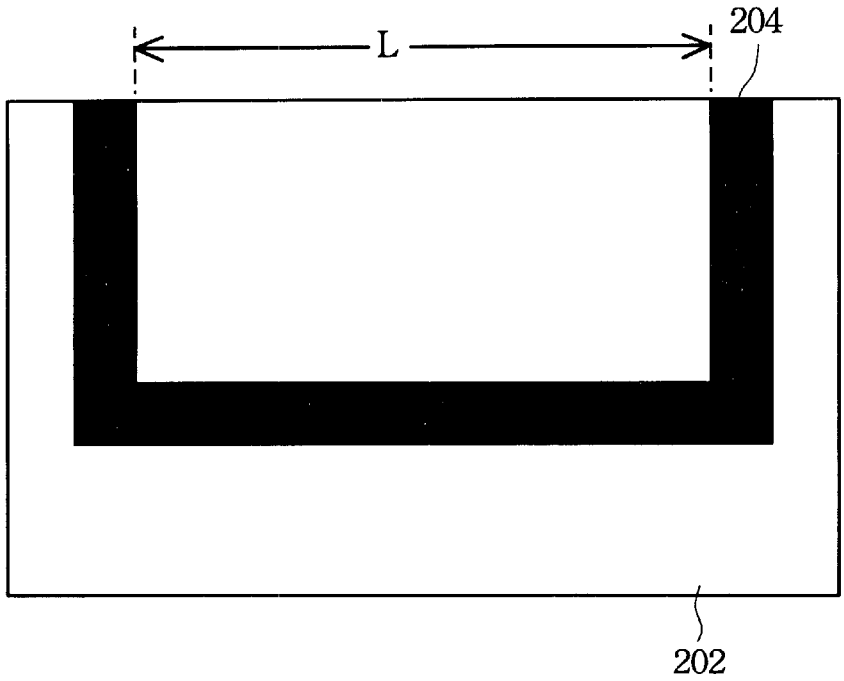
FIG. 3, FIG. 4 and FIG. 5 are schematic top views of the process of forming a package structure in accordance with the present invention.
Figure 4:
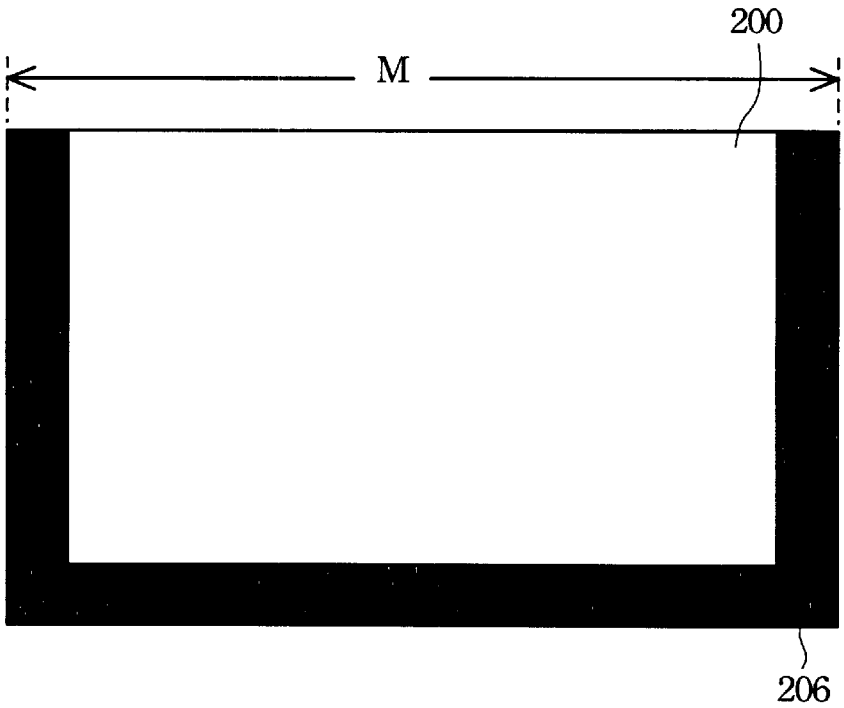
Figure 5:
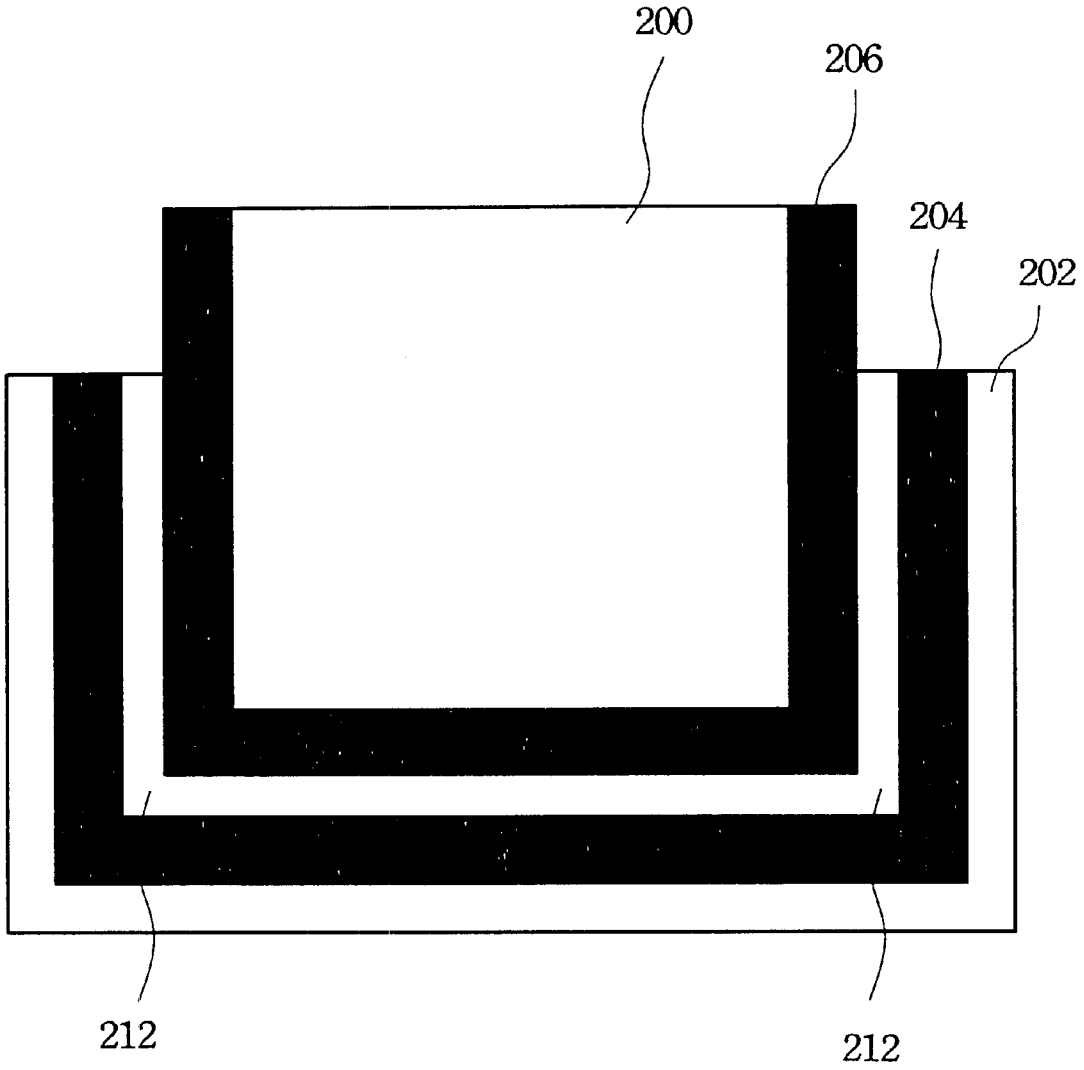

FIGS. 3–5 illustrate the package method. FIG. 3 is a schematic top view of the cathode plate 202 of a field emission display. The cathode plate 202 includes a glass substrate whereon the emitter is deposited or coated. The thickness of the glass substrate is about 0.5 mm to 2.8 mm. When packaging, first, photolithography or laser process is used to fix the position of the side glass 204 on the cathode plate 202. Then, the glass frits 208 is used to bond the side glass 204 on the cathode plate 202. The height of the side glass 204 is about 0.5 mm to 2 mm and the position pattern is an inverted square "u"-type. FIG. 4 is a schematic top view of the anode plate 200 of a field emission display. The anode plate 200 includes a glass substrate whereon a layer of fluorescence material is deposited. The thickness of the glass substrate is about 0.5 mm to 2.8 mm. When packaging, first, photolithography or laser process is used to fix the position of the side glass 206 on the anode plate 200. Then, the glass frits 208 is used to bond the side glass 206 to the anode plate 200. The height of the side glass 206 is equal to the height of the side glass 204 and the thickness of the glass substrate and the position pattern is an inverted square "u"-type. Referring to FIG. 5, during the alignment process, first, the anode plate 200 is reversed. That is, the front of the anode plate is down. At the same time, the front of the cathode plate 202 is up. Next, an alignment process is performed to generate a gap 212 between the side glass 206 and the side glass 204; the width of the gap is about 1 mm to 2 mm. Then, the glass frits 208 is used to fill the gap 212. Next, the whole structure undergoes a thermal cycle at a temperature of about 300 to 450° C. Through the thermal cycle, the side glasses are adhered to each other by the glass frits so that the anode plate and the cathode plate may be sealed. Finally, a getter box (not shown in the figure) is used to cover the opening after the anode plate and the cathode plate are sealed, and a vacuum process is performed to achieve the required operation pressure.

The length of the anode plate is usually shorter than that of the cathode plate. For example, if L is the distance between the side glass of the cathode plate 202 (as shown in the FIG. 3), the distance M between the side glass of the anode plate 202 (as shown in the FIG. 4) is equal to the difference between L and twice the gap.

In accordance with the present invention, the glass frits 208 is only applied to one end of the side glass 206. That is, the glass frits 208 is only applied to the adjoining part of the side glasses 206 and the anode plate 200 but not to the adjoining part of the side glasses 206 and the cathode plate 202. The way to seal the anode plate 200 and cathode plate 202 is to fill the gap 212 between the side glasses 206 and 204 with glass frits 208. Therefore, even though non-uniform glass frits exists between the side glass 206 and anode plate 200, the crack issues of the glass substrate may be reduced because it is not necessary to apply glass frits to the adjoining part of the side glasses 206 and the cathode plate 202.

As is understood by a person skilled in the art, the foregoing preferred embodiment of the present invention is illustrative rather than limiting of the present invention. It is intended to cover various modifications and similar arrangements included within the spirit and scope of the appended claims, the scope of which should be accorded the broadest interpretation so as to encompass all such modifications and similar structure.

While the preferred embodiment of the invention has been illustrated and described, it will be appreciated that various changes can be made therein without departing from the spirit and scope of the invention.

What is claimed is:

1. A package method of field emission display, said method comprises the following steps of:

fixing a position of a side glass having an opening around a cathode plate front;

bonding a first side glass in said side glass position on said cathode plate;

fixing the side glass position having an opening around the anode plate front;

bonding the second side glass to said side glass position on said anode plate;

forming an alignment structure by locating said side glass openings of said anode plate and said cathode plate having identical orientation to make said second side glass contact said cathode plate front and form a gap inside said first side glass;

filling said gap with a glass frits; and performing a thermal cycle on said alignment structure.

2. The method of claim 1, wherein a layer of fluorescent material is deposited on said front of said anode plate.

3. The method of claim 1, wherein a layer of electron-emitting material is deposited on said front of said cathode plate.

4. The method of claim 1, wherein said method of fixing the position uses photolithography or a laser process.

5. The method of claim 1, wherein said bonding method comprises application of the glass frits to said first and second side glasses and bonding them to said anode or cathode plate.

6. The method of claim 1, wherein said cathode plate comprises glass having a thickness of about 0.5 mm to 2.8 mm.

7. The method of claim 1, wherein said anode plate comprises glass having a thickness of about 0.5 mm to 2.8 mm.

8. The method of claim 1, wherein said thermal cycle is performed at a temperature of about 300° C. to 450° C.

9. The method of claim 1, wherein said first side glass has a height equal to a height of said second side glass and a thickness of said anode plate.

10. The method of claim 1, wherein said gap has a width of about 1 mm to 2 mm.

11. A package structure of field emission display, said structure comprising:

an anode plate, wherein a layer of fluorescent material is deposited on a front thereof; a cathode plate, wherein a layer of electron-emitting material is deposited on a front thereof;

a first side glass, wherein one end thereof is bound around the anode plate front but having an opening and another end contacts said cathode plate front;

a second side glass, wherein one end of said second side glass is bound around the cathode plate front, has an opening identical in location to said opening located on said anode plate and forms a gap beside said first side glass; and filling said gap with a glass frits.

12. The structure of claim 11, wherein said cathode plate comprises glass having a thickness of about 0.5 mm to 2.8 mm.

13. The structure of claim 11, wherein said anode plate comprises glass having a thickness of about 0.5 mm to 2.8 mm.

14. The structure of claim 11, wherein said second side glass has a height equal to a height of said first side glass and a thickness of said anode plate.

15. The structure of claim 11, wherein said gap has a width of about 1 mm to 2 mm.

* * * * *